US010753306B2

(12) United States Patent
Imai et al.

(10) Patent No.: US 10,753,306 B2
(45) Date of Patent: Aug. 25, 2020

(54) EXHAUST GAS PURIFICATION SYSTEM FOR INTERNAL COMBUSTION ENGINE

(71) Applicant: TOYOTA JIDOSHA KABUSHIKI KAISHA, Toyota-shi, Aichi-ken (JP)

(72) Inventors: Daichi Imai, Sunto-gun (JP); Toshihiro Mori, Gotemba (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/508,609

(22) Filed: Jul. 11, 2019

(65) Prior Publication Data

US 2020/0072156 A1 Mar. 5, 2020

(30) Foreign Application Priority Data

Sep. 4, 2018 (JP) ..... 2018-165300

(51) Int. Cl.

| | |
|---|---|
| ***F02D 41/04*** | (2006.01) |
| ***F02D 43/04*** | (2006.01) |
| ***F02D 41/00*** | (2006.01) |
| ***F02D 41/40*** | (2006.01) |
| ***F02P 5/15*** | (2006.01) |
| ***F02P 5/04*** | (2006.01) |

(52) U.S. Cl.

CPC ..... *F02D 43/04* (2013.01); *F02D 41/0047* (2013.01); *F02D 41/401* (2013.01); *F02P 5/045* (2013.01); *F02P 5/15* (2013.01); *F02D 2200/023* (2013.01); *F02D 2200/0414* (2013.01)

(58) Field of Classification Search

CPC .. F02D 41/0047; F02D 41/401; F02D 41/144; F02D 41/403; F02D 41/0275; F02D 2200/023; F02D 2200/0414; F02P 5/15; F02P 5/045

USPC ..... 123/568.21, 443; 701/108

See application file for complete search history.

(56) References Cited

U.S. PATENT DOCUMENTS

| | | | | |
|---|---|---|---|---|
| 10,174,695 | B2 * | 1/2019 | Hotta | F02D 41/0055 |
| 2006/0075740 | A1 * | 4/2006 | Twigg | F01N 3/0842 60/285 |

FOREIGN PATENT DOCUMENTS

| | | | |
|---|---|---|---|
| JP | 2004-257331 | A | 9/2004 |
| JP | 2005-048629 | A | 2/2005 |
| JP | 2014-214730 | A | 11/2014 |
| JP | 2018-096243 | A | 6/2018 |

* cited by examiner

*Primary Examiner* — Hai H Huynh

(74) *Attorney, Agent, or Firm* — Oliff PLC

(57) ABSTRACT

The exhaust gas purification system includes a catalyst having an NOx storage and reduction function, an EGR passage, and a controller configured to control combustion of the internal combustion engine. The controller is configured to switch the operation mode from the lean burn operation to the rich burn operation, when a request for execution of the rich burn operation is issued during the lean burn operation. The controller is configured to perform, when the request the execution of the rich burn operation is issued, an NOx-increasing process in which the combustion of the internal combustion engine is controlled so that an in-cylinder NOx amount is equal to or larger than a required in-cylinder NOx amount prior to switching to the rich burn operation.

7 Claims, 7 Drawing Sheets

EXHAUST GAS PURIFICATION SYSTEM FOR INTERNAL COMBUSTION ENGINE

CROSS-REFERENCE TO RELATED APPLICATION

The present disclosure claims priority under 35 U.S.C. § 119 to Japanese Patent Application No. 2018-165300, filed on Sep. 4, 2018. The contents of this application are incorporated herein by reference in their entirety.

FIELD

The present disclosure relates to an exhaust gas purification system for an internal combustion engine, and more particularly to an exhaust gas purification system for an internal combustion engine including a catalyst having an NOx storage and reduction function.

BACKGROUND

JP 2004-257331 A discloses a technique for facilitating activation of a catalyst under such conditions that the catalyst becomes inactive. In this technique, the catalyst activation operation by which the operation of the variable valve timing mechanism is changed to increase the exhaust gas amount remaining in the combustion chamber after the exhaust period of the combustion chamber is performed. According to such an operation, the air-fuel ratio in the combustion chamber is set to the richer side to increase carbon monoxide gas in the exhaust gas, and accordingly, the catalyst temperature is increased. As a result, the activation of the catalyst is facilitated even under a condition that the catalyst becomes inactive.

SUMMARY

Under the operating condition where the engine load is low, the reduction in the in-cylinder temperature and the reduction in the air amount lead to tendency of deterioration of the ignition performance. Therefore, in the above-described technique, when the air-fuel ratio of the combustion chamber is set to the richer side under the operating condition where the engine load is low, a problem such as misfire that affects the ignition performance may occur.

Such a problem relating to the ignition performance in a specific operating region may occur even in the lean burn engine including an NSR catalyst having an NOx storage and reduction function, for example. Specifically, in the lean burn engine including the NSR catalyst, it is required to regularly execute the rich burn operation in which the in-cylinder air-fuel ratio is set at the air-fuel ratio richer in fuel than the theoretical air-fuel ratio, to recover the NOx reduction function of the NSR catalyst. However, when the rich burn operation is executed under the operation condition where the engine load is low, a problem such as misfire that affects the ignition performance may occur. When the rich burn operation is executed while avoiding such an operating condition, the recovery period of the reduction performance of the catalyst is delayed, during which the exhaust emission may be deteriorated.

The present disclosure has been made in view of the above-described problems, and an object of the present disclosure is to provide an exhaust purification system for an internal combustion engine capable of performing a combustion control for recovering the functions of the catalyst in a variety of operating conditions, in the internal combustion engine including a catalyst having an NOx storage and reduction function.

To solve the above-described problems, according to a first aspect of the present disclosure, an exhaust gas purification system for an internal combustion engine is provided. The exhaust gas purification system includes a catalyst provided in an exhaust passage of the internal combustion engine and having an NOx storage and reduction function, an EGR passage for returning exhaust gas provided upstream of the catalyst into a cylinder of the internal combustion engine, and a controller configured to control combustion of the internal combustion engine. Operation modes of the internal combustion engine selected by the controller include a lean burn operation in which an in-cylinder air-fuel ratio of the internal combustion engine is controlled to a lean air-fuel ratio leaner in fuel than a theoretical air-fuel ratio to operate the internal combustion engine, and a rich burn operation in which the in-cylinder air-fuel ratio is controlled to a required rich air-fuel ratio richer in fuel than the theoretical air-fuel ratio to supply a reducer to the catalyst. The controller is configured to switch the operation mode from the lean burn operation to the rich burn operation when a request for execution of the rich burn operation is issued during the lean burn operation. The controller is configured to perform, when the request for execution is issued, an NOx-increasing process in which the combustion of the internal combustion engine is controlled so that an in-cylinder NOx amount which is an amount of NOx sucked into the cylinder through an EGR passage is equal to or larger than a required in-cylinder NOx amount which is a required value of the in-cylinder NOx amount prior to switching to the rich burn operation.

A second aspect of the present disclosure further has the following features in addition to the first aspect.

The NOx-increasing process includes setting the required in-cylinder NOx amount based on an intake air temperature of intake air sucked into the cylinder and the required rich air-fuel ratio.

A third aspect of the present disclosure further has the following features in addition to the first aspect.

The NOx-increasing process includes an ignition timing advance process in which ignition timing of the internal combustion engine is advanced.

A fourth aspect of the present disclosure further has the following features in addition to the third aspect.

The ignition timing advance process includes advancing fuel injection timing of the internal combustion engine.

A fifth aspect of the present disclosure further has the following features in addition to the third aspect.

The NOx-increasing process includes a rich-approach process in which the in-cylinder air-fuel ratio is controlled to a rich-approach air-fuel ratio leaner in fuel than the required rich air-fuel ratio based on the in-cylinder NOx amount and the intake air temperature of the intake air sucked into the cylinder.

A sixth aspect of the present disclosure further has the following features in addition to the fifth aspect.

The NOx-increasing process includes an ignition timing correction process in which the ignition timing is further corrected to be advanced based on changes in in-cylinder temperature after the rich-approach process.

A seventh aspect of the present disclosure further has the following features in addition to the fifth aspect.

The NOx-increasing process includes updating the required in-cylinder NOx amount based on the intake air temperature after the rich-approach process.

According to the first aspect of the present disclosure, the in-cylinder NOx amount is increased to be equal to or larger than the required in-cylinder NOx amount prior to switching from the lean burn operation to the rich burn operation. When the in-cylinder NOx amount is increased, the ignition performance is improved. Therefore, according to the present disclosure, the ignition performance can be improved prior to the rich burn operation, thereby enabling the rich burn operation for recovering the functions of the catalyst in a variety of operating conditions.

According to the second aspect of the present disclosure, the required in-cylinder NOx amount is set based on the intake air temperature and the required rich air-fuel ratio. When the intake air temperature is lowered, the ignition performance is reduced. Therefore, when the intake air temperature is lowered, the required in-cylinder NOx amount required to secure the ignition performance at the required rich air-fuel ratio is increased. When the required rich air-fuel ratio is richer in fuel, the required in-cylinder NOx amount required to secure the ignition performance is increased. Therefore, according to the present disclosure the required in-cylinder NOx amount required to secure the ignition performance can be appropriately set.

According to the third aspect of the present disclosure, the combustion temperature can be increased by the ignition timing advance process. Thereby, the amount of NOx in the exhaust gas can be increased, whereby the in-cylinder amount of NOx sucked into the cylinder through the EGR passage can be increased.

According to the fourth aspect of the present disclosure, the fuel injection timing is advancer, thereby capable of advancing the ignition timing.

According to the fifth aspect of the present disclosure, the in-cylinder air-fuel ratio is controlled to the rich-approach air-fuel ratio determined by the in-cylinder NOx amount and the intake air temperature. Accordingly, the in-cylinder temperature can be increased, thereby capable of effectively increasing the in-cylinder NOx amount.

When the in-cylinder temperature is increased by the rich-approach process, the ignition timing can be further advanced without lowering the in-cylinder temperature at the ignition. According to the sixth aspect of the present disclosure, the ignition timing is further corrected to be advanced after the rich-approach process, and thereby the in-cylinder NOx amount can be further increased thereby approaching the required in-cylinder NOx amount.

According to the seventh aspect of the present disclosure, the required in-cylinder NOx amount is updated to a lower value by increasing the intake air temperature after the rich-approach process. Thereby, the in-cylinder NOx amount can approach the required in-cylinder NOx amount.

DESCRIPTION OF EMBODIMENTS

Hereinafter, embodiments of the present disclosure will be described with reference to the accompanying drawings. However, it is to be understood that even when the number, quantity, amount, range or other numerical attribute of each element is mentioned in the following description of the embodiments, the present disclosure is not limited to the mentioned numerical attribute unless explicitly described otherwise, or unless the present disclosure is explicitly specified by the numerical attribute theoretically. Furthermore, structures or steps or the like that are described in conjunction with the following embodiments are not necessarily essential to the present disclosure unless explicitly described otherwise, or unless the present disclosure is explicitly specified by the structures, steps or the like theoretically.

First Embodiment

A first embodiment will be described with reference to the accompanying drawings.

1-1. Configuration According to First Embodiment

Figure 1:
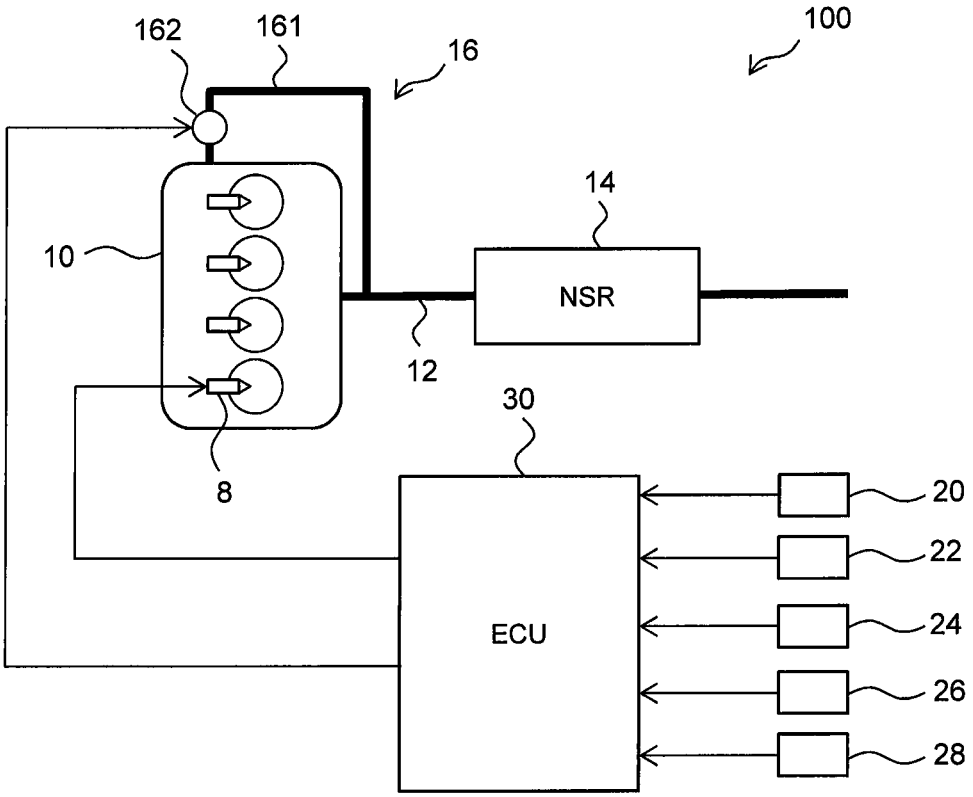
FIG. 1 is a diagram for illustrating a configuration according to a first embodiment.

FIG. 1 is a diagram for illustrating a configuration according to the first embodiment. As illustrated in FIG. 1, an exhaust gas purification system 100 according to the present embodiment includes an internal combustion engine (engine) 10. The engine 10 according to the present embodiment is a diesel engine. In the engine 10, four cylinders are disposed in series, and an injector 8 is provided for each of the cylinders. An intake manifold and an exhaust manifold are mounted on the engine 10 (both not illustrated). An exhaust passage 12 for releasing exhaust gas discharged from the engine 10 into the atmosphere is connected to the exhaust manifold.

An NSR (NOx Storage Reduction) catalyst 14 is arranged in the exhaust passage 12. The NSR catalyst 14 is a catalyst having an absorption function of NOx and a reduction function of NOx. Note that so-called NOx adsorption catalysts (PNA; Passive NOx Adsorbers) having an adsorption function of NOx are included in the NSR catalyst 14 of the present specification.

The NSR catalyst 14 stores NOx contained in exhaust gas under the lean atmosphere. In addition, the NSR catalyst 14 releases the stored NOx under the rich atmosphere. The NOx released under the rich atmosphere is reduced by HC or CO.

The exhaust gas purification system 100 illustrated in FIG. 1 includes an EGR device 16 for returning the exhaust gas flowing in the exhaust passage 12 into the cylinders of the engine 10. The EGR device 16 connects the exhaust passage 12 provided upstream of the NSR catalyst 14 and the intake manifold through an EGR passage 161. An EGR valve 162 is provided in the EGR passage 161.

The exhaust gas purification system 100 according to the present embodiment includes an ECU (Electronic Control Unit) 30. The ECU 30 is a controller that performs overall control of the entire exhaust gas purification system. The controller according to the present disclosure is achieved as one function of the ECU 30.

The ECU 30 includes at least an input/output interface, a ROM, a RAM, and a CPU. The input/output interface takes in signals from sensors provided in the exhaust gas purification system 100, and outputs actuating signals to actuators provided in the engine 10. The sensors are installed at various places in the system 100. An air-fuel ratio sensor 20 is provided upstream of the NSR catalyst 14 in the exhaust passage 12. The air-fuel ratio sensor 20 can detect the exhaust air-fuel ratio of the engine 10. An NOx sensor 22 is provided to the intake manifold. The NOx sensor 22 detects an amount of NOx contained in intake air. A temperature sensor 24 for detecting an intake air temperature is installed in the intake manifold. Furthermore, a rotational speed sensor 26 that detects the rotational speed of a crankshaft, and an accelerator opening sensor 28 that outputs a signal in accordance with an opening degree of an accelerator pedal are also installed at the intake manifold. The ECU 30 processes the signals from the respective sensors which the ECU 30 takes in, and operates the respective actuators in accordance with a predetermined control program. The actuators that are actuated by the ECU 30 include the injector 8, the EGR valve 162, and the like. Various kinds of control data including various control programs and maps for controlling the engine 10 are stored in the ROM. The CPU reads out a control program from the ROM and executes the control program, and generates actuating signals based on sensor signals which the CPU takes in. Note that the actuators and sensors connected to the ECU 30 also include a large number of actuators and sensors that are not illustrated in the drawing, and the description of such actuators and sensors is omitted from the present specification.

1-2. Combustion Control in First Embodiment

The combustion control of the engine 10 that is executed by the ECU 30 includes an air-fuel ratio control. In the air-fuel ratio control of the present embodiment, the fuel injection amount from the injector 8 is controlled so that the in-cylinder air-fuel ratio becomes a required in-cylinder air-fuel ratio. In the engine 10 of the first embodiment, the ECU 30 usually sets the required in-cylinder air-fuel ratio at a lean air-furl ratio that is leaner in fuel than the theoretical air-fuel ratio. In the following description, the operation of the engine 10 at the lean air-fuel ratio is referred to as a "lean burn operation". During the lean burn operation, oxidizers such as NOx are discharged in a larger amount than reducers such as HC and CO. Therefore, even when the exhaust gas is to be purified using a three-way catalyst, all of NOx cannot be purified due to insufficiency of the reducers. Then, the system 100 of the present embodiment includes the NSR catalyst 14 at the exhaust passage 12. The NSR catalyst 14 has the function of storing NOx as nitrate such as $BA(NO_3)_2$. Therefore, according to the system 100 of the first embodiment, even during the lean burn operation, the situation in which the NOx is released into the atmosphere can be effectively suppressed.

However, the NOx storing performance of the NSR catalyst 14 reduces as the storage amount increases. Therefore, when the lean burn operation is continued for a long time period, the NOx flows downstream of the exhaust passage 12 without being stored in the NSR catalyst 14. Then, in the system of the first embodiment, the rich burn operation that regularly desorbs the NOx stored in the NSR catalyst 14 and treats the NOx is executed. Specifically, when a condition for execution of the rich burn operation is established, the ECU 30 switches the operation mode of the engine 10 from the lean burn operation to the rich burn operation. During the rich burn operation, the ECU 30 sets the required air-fuel ratio at the air-fuel ratio (A/F=14.6, for example) that is richer in fuel than the theoretical air-fuel ratio. By making the in-cylinder air-fuel ratio richer in fuel than the theoretical air-fuel ratio, the oxygen concentration contained in the exhaust gas decreases and a large amount of reducers such as HC, CO and $H_2$ are generated. As a result of the exhaust gas that includes a large amount of reducers being supplied to the NSR catalyst 14, NOx stored in the NSR catalyst 14 is released from the NSR catalyst 14 and is reduced to $NH_3$ or $N_2$ on the NSR catalyst 14.

Note that in the system 100 of the present embodiment in which a request for the execution of the rich burn operation is issued when the NOx storing performance of the NSR catalyst 14 needs to be recovered, the request for execution is issued when a stored amount of NOx that is calculated by estimation based on, for example, the engine speed, the intake air amount, and the air-fuel ratio exceeds a predetermined threshold value. Alternatively, the system 100 of the present embodiment may be configured such that the request for execution is issued when the NOx concentration at the outlet of the NSR catalyst 14 that is measured by the NOx sensor or the like exceeds a predetermined threshold value.

1-3. Problem of Rich Burn Operation

Figure 2:
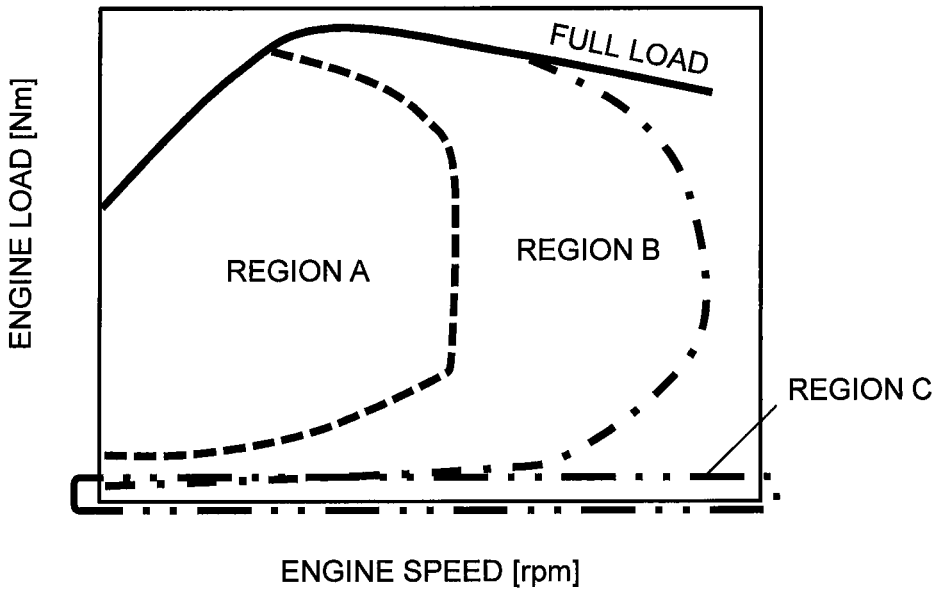
FIG. 2 is a diagram showing a region in which a rich burn operation can be executed.

The ECU 30 executes the rich burn operation when receiving the request for the execution of the rich burn operation during the lean burn operation. Here, the ignition performance of the engine 10 varies depending on operating conditions. FIG. 2 is a diagram showing a region in which the rich burn operation can be executed. A region A surrounded by a dotted line in FIG. 2 illustrates a region in which the rich air-fuel ratio can be achieved by the rich burn operation. In the following description, this region A is referred to as a "rich burn enabled region". A region B surrounded by a one-dot chain line in FIG. 2 illustrates a region in which the rich air-fuel ratio cannot be achieved only by the rich burn operation, but the rich air-fuel ratio can be achieved in combination with the fuel supply control by which the fuel is directly supplied to the exhaust gas from a fuel supply valve provided in the exhaust passage 12. In the following description, this region B is referred to as a "conditional rich burn enabled region". A region C surrounded by a two-dot chain line in FIG. 2 illustrates a region in which it is difficult to achieve the rich air-fuel ratio even when the rich burn operation is executed in combination with the fuel supply control. In the following description, this region C is referred to as a "rich burn difficult region".

As illustrated in FIG. 2, the rich burn difficult region is distributed in a region in which the engine load is extremely low. This is because the ignition performance is lowered under such a low load condition of the engine 10 due to a decrease in in-cylinder temperature and a reduction in the intake air amount. When the operating conditions of the engine 10 belong to the rich burn difficult region, the ECU 30 cannot execute the rich burn operation even when receiving the request for the execution of the rich burn operation.

If the execution of the rich burn operation is delayed, NOx that cannot be adsorbed to the NSR catalyst 14 may flow downstream.

1-4. Feature of First Embodiment

Figure 3:
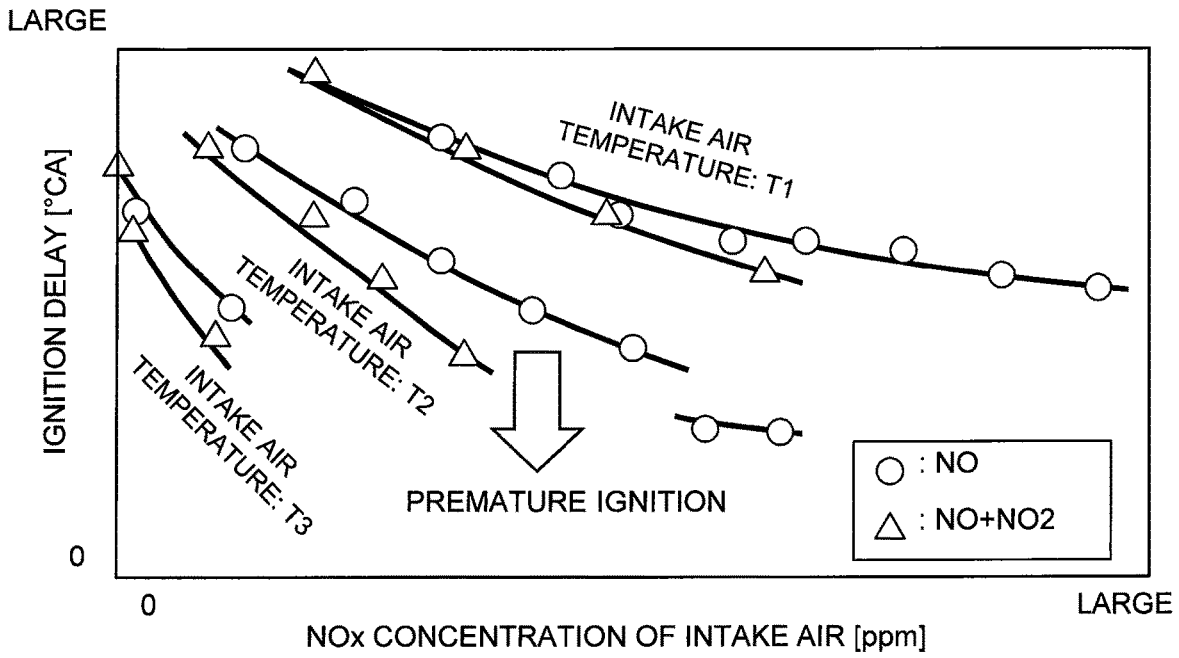
FIG. 3 is a graph showing a relationship between an NOx concentration of intake air and an ignition delay when NOx is mixed in the intake air.

The inventors of the present disclosure have eagerly studied to solve the above-described problems. As a result, the present inventors have found that an in-cylinder NOx amount which is an amount of NOx sucked into the cylinder of the engine 10 affects the ignition performance. FIG. 3 is a graph showing a relationship between an NOx concentration of the intake air and an ignition delay when NOx is mixed in the intake air. FIG. 3 shows the relationship in a case where NO is mixed in the intake air and the relationship in a case where NO and $NO_2$ are mixed. Furthermore, FIG. 3 shows the relationships when the intake air temperatures are T1, T2 (>T1), and T3 (>T2), respectively. The present inventors have newly found that, as shown in FIG. 3, when the NOx concentration [ppm] of the intake air is increased, the ignition delay [CA°] is reduced, thereby improving the ignition performance. It has been found that the ignition performance is remarkably improved as the intake gas temperature increases.

Figure 4:
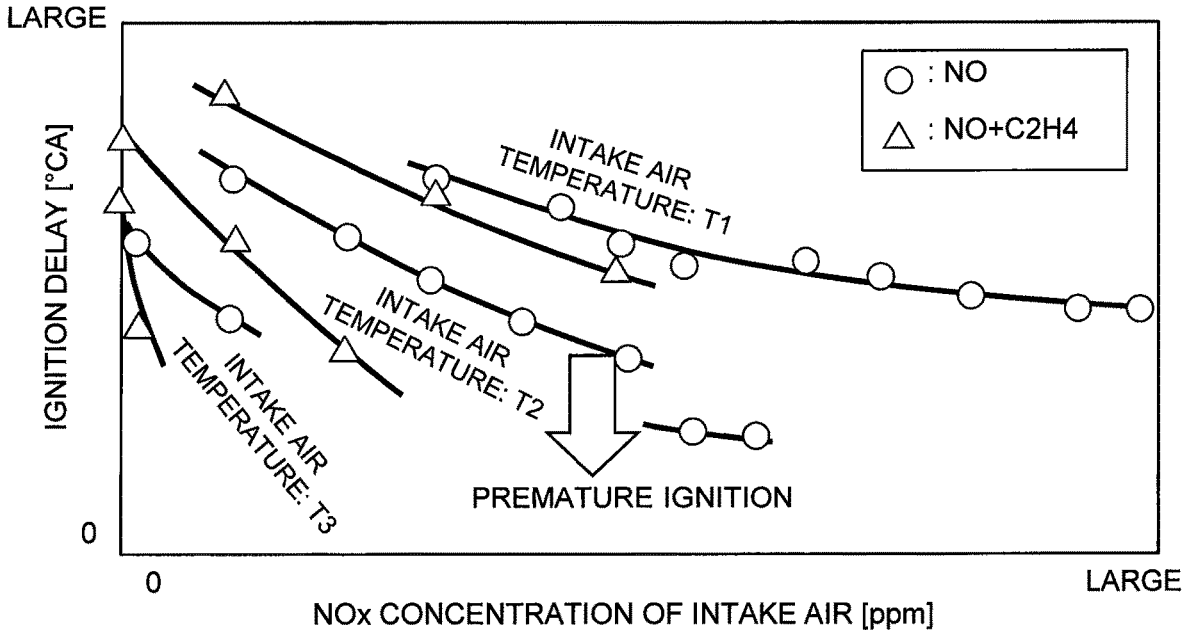
FIG. 4 is a graph showing a relationship between an NOx concentration of the intake air and an ignition delay when NO and HC are mixed in the intake air.

FIG. 4 is a graph showing a relationship between an NOx concentration of the intake air and an ignition delay when NO and HC are mixed in the intake air. FIG. 4 shows the relationship in a case where NO is mixed in the intake air and the relationship in a case where NO and C2H4 are mixed. Furthermore, FIG. 4 shows the relationships when the intake air temperatures are T1, T2 (>T1), and T3 (>T2), respectively. The present inventors have newly found that, as shown in FIG. 4, even when NOx and HC are mixed, the relationship that when the NOx concentration [ppm] of the intake air is increased, the ignition delay [CA°] is reduced is maintained.

Based on the above-described findings, the system 100 of the first embodiment is characterized in the operation of expanding the operating region in which the rich burn operation can be executed. Specifically, in the system 100 of the first embodiment, when the operating conditions of the engine 10 belong to the rich burn difficult region, the NOx-increasing process for increasing an amount of NOx in the cylinder is performed prior to the rich burn operation. In the system 100 of the first embodiment, when the amount of NOx in the cylinder after the NOx-increasing process does not reach a required in-cylinder NOx amount which is a required value of an amount of NOx in the cylinder, a rich-approach process for shifting the in-cylinder air-fuel ratio to a fuel rich side is performed. Furthermore, in the system 100 of the first embodiment, an ignition timing correction process for correcting the ignition timing to be further advanced after the rich-approach process. Hereinafter, these processes will be described in more detail.

1-5. NOx-Increasing Process

Figure 5:
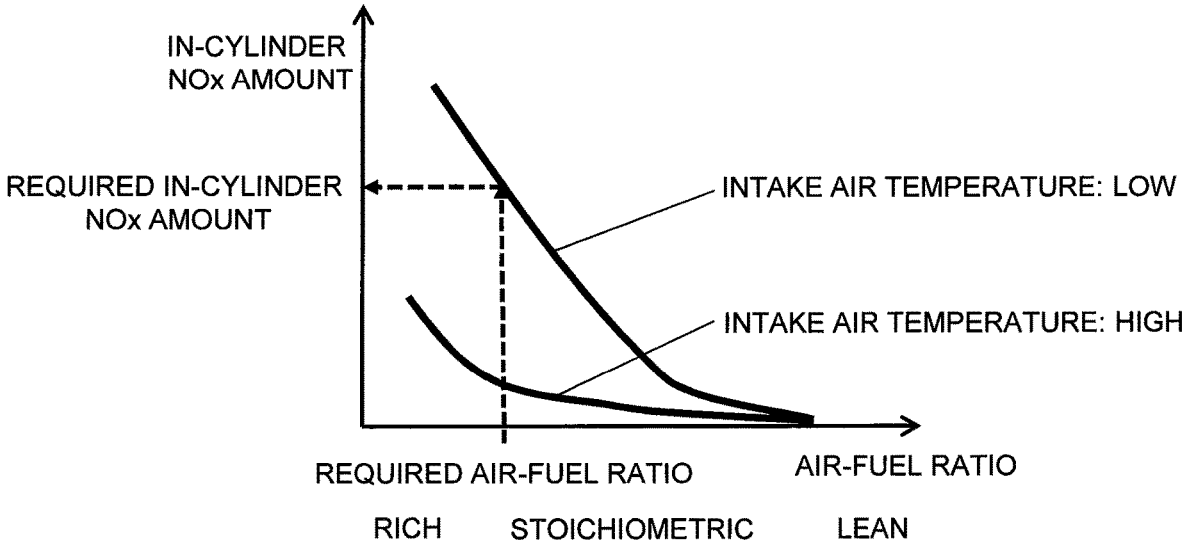
FIG. 5 is a graph showing an in-cylinder NOx amount for each intake air temperature to achieve the in-cylinder air-fuel ratio.

The NOx-increasing process is a process for increasing an amount of NOx in the cylinder prior to the rich burn operation. In the NOx-increasing process, the ECU 30 first determines a required in-cylinder NOx amount for the NOx-increasing process. FIG. 5 is a graph showing the in-cylinder NOx amount for each intake air temperature to achieve the in-cylinder air-fuel ratio. The ECU 30 determines the required in-cylinder NOx amount corresponding to the in-cylinder air-fuel ratio in the rich burn operation and the current intake air temperature using the relationships shown in FIG. 5. Next, the ECU 30 performs the ignition timing advance process for advancing the ignition timing so that the in-cylinder NOx amount approaches the required in-cylinder NOx amount. Specifically, in the ignition timing advance process, the ECU 30 advances the ignition timing by advancing the fuel injection timing of a main injection or a pilot injection from the injector 8 during a period in which the EGR valve 162 is opened. This enables the combustion temperature in the cylinder to be increased, thereby increasing the amount of NOx in the exhaust gas. The exhaust gas flows in the EGR passage 161 and is returned into the cylinders, thereby increasing the in-cylinder NOx amount. Thus, according to the NOx-increasing process, the in-cylinder NOx amount can approach the required in-cylinder NOx amount. Note that the method of advancing the ignition timing by the ignition timing advance process is not limited thereto. That is, the ignition timing may be advanced by increasing a rail pressure of a common rail, for example.

1-6. Rich-Approach Process

Figure 6:
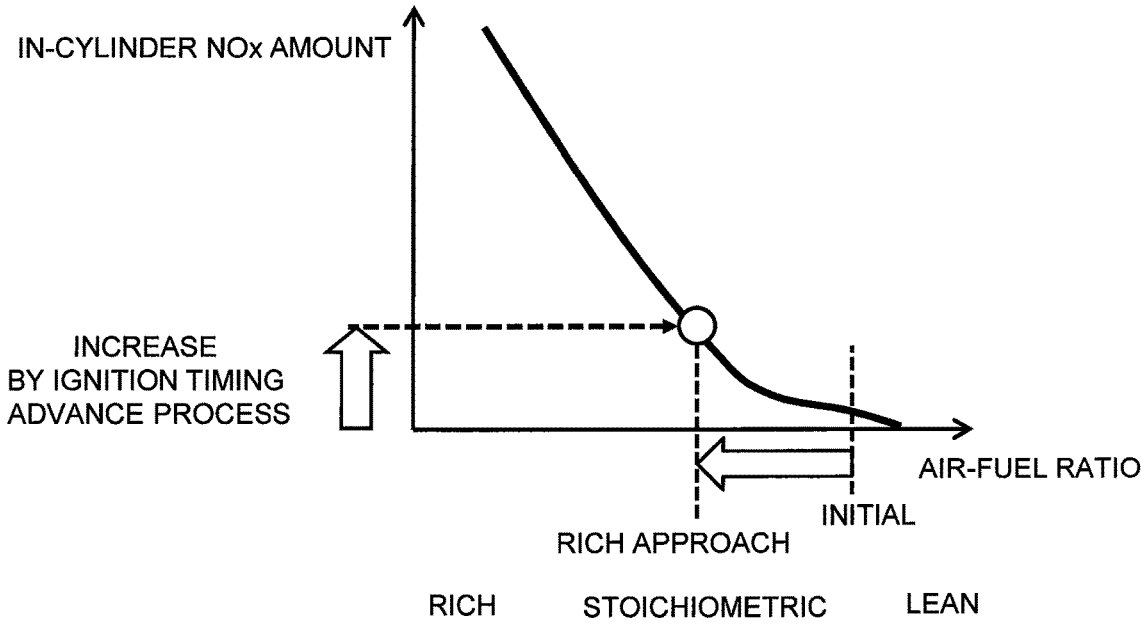
FIG. 6 is a graph showing the rich-approach process.

The rich-approach process is a process for shifting the in-cylinder air-fuel ratio to a fuel rich side within such a range that the ignition performance can be secured when the in-cylinder NOx amount after the NOx-increasing process does not reach a required in-cylinder NOx amount. FIG. 6 is a graph showing the rich-approach process. As shown in FIG. 6, when the ignition timing is advanced by the NOx-increasing process to increase the in-cylinder NOx amount, a limit value of the in-cylinder air-fuel ratio at which the ignition performance can be secured is shifted to the fuel rich side. The ECU 30 calculates the limit value when the in-cylinder air-fuel ratio is shifted to the rich side, based on the current intake air temperature and in-cylinder NOx amount. In the following description, this limit value is referred to as a "rich-approach limit air-fuel ratio". The ECU 30 controls the in-cylinder air-fuel ratio of the engine 10 to the calculated rich-approach limit air-fuel ratio. When the rich-approach process is performed, the temperature of the exhaust gas increases. Thus, since the temperature of the exhaust gas returned through the EGR passage 161 increases, the intake air temperature increases. The required in-cylinder NOx amount is reduced when the intake air temperature increases, thereby capable of reducing a difference between the required in-cylinder NOx amount and the in-cylinder NOx amount.

1-7. Ignition Timing Correction Process

Figure 7:
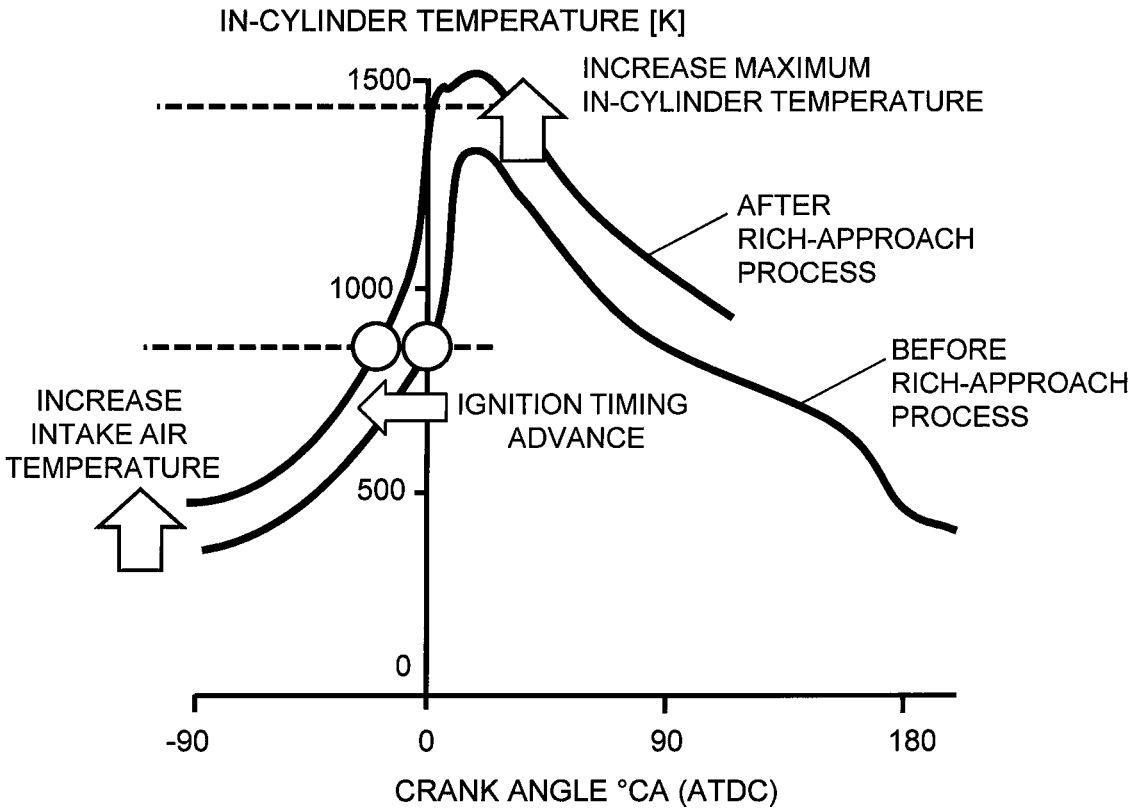
FIG. 7 is a graph showing changes in an in-cylinder temperature with respect to a crank angle that are compared before and after the rich-approach process.

The ignition timing correction process is a process for correcting the fuel injection timing from the injector 8 to be advanced when the in-cylinder temperature is increased by the rich-approach process. FIG. 7 is a graph showing changes in the in-cylinder temperature with respect to the crank angle that are compared before and after the rich-approach process. As shown in FIG. 7, after the rich-approach process is performed, the in-cylinder temperature is increased as compared with that before the rich-approach process is performed. This is caused by increase in the combustion temperature is increased because the in-cylinder air-fuel ratio is shifted to the fuel rich side, and increase in the intake air temperature because the exhaust gas having higher temperature is returned through the EGR passage 161. Therefore, after the rich-approach process, the ignition timing can be further advanced than that before the rich-approach process even when the fuel is ignited at the same temperature as that before the rich-approach process, for example.

In the ignition timing correction process, the ECU 30 calculates an advanced angle amount of the ignition timing corresponding to the increase from the previous value of the estimated in-cylinder temperature. Then, the ECU 30 corrects the fuel injection timing of the main injection or the pilot injection from the injector 8 to be advanced, based on the calculated advanced angle amount. According to such an ignition timing correction process, the ignition timing is further advanced, thereby capable of further increasing the in-cylinder NOx amount.

Thus, according to the system 100 of the first embodiment, when the operating conditions of the engine 10 belong to the rich burn difficult region, the in-cylinder NOx amount can be increased to the required in-cylinder NOx amount or more by the NOx-increasing process, the rich-approach process, and the ignition timing correction process. Therefore, the operating region in which the rich burn operation can be executed can be expanded, thereby capable of suppressing the delay of the rich burn operation to prevent emission from deteriorating.

1-8. Specific Processing of Control Executed in System of First Embodiment

Next, specific routine processing executed by the ECU 30 during the lean burn operation will be described according to the flowchart.

Figure 8:
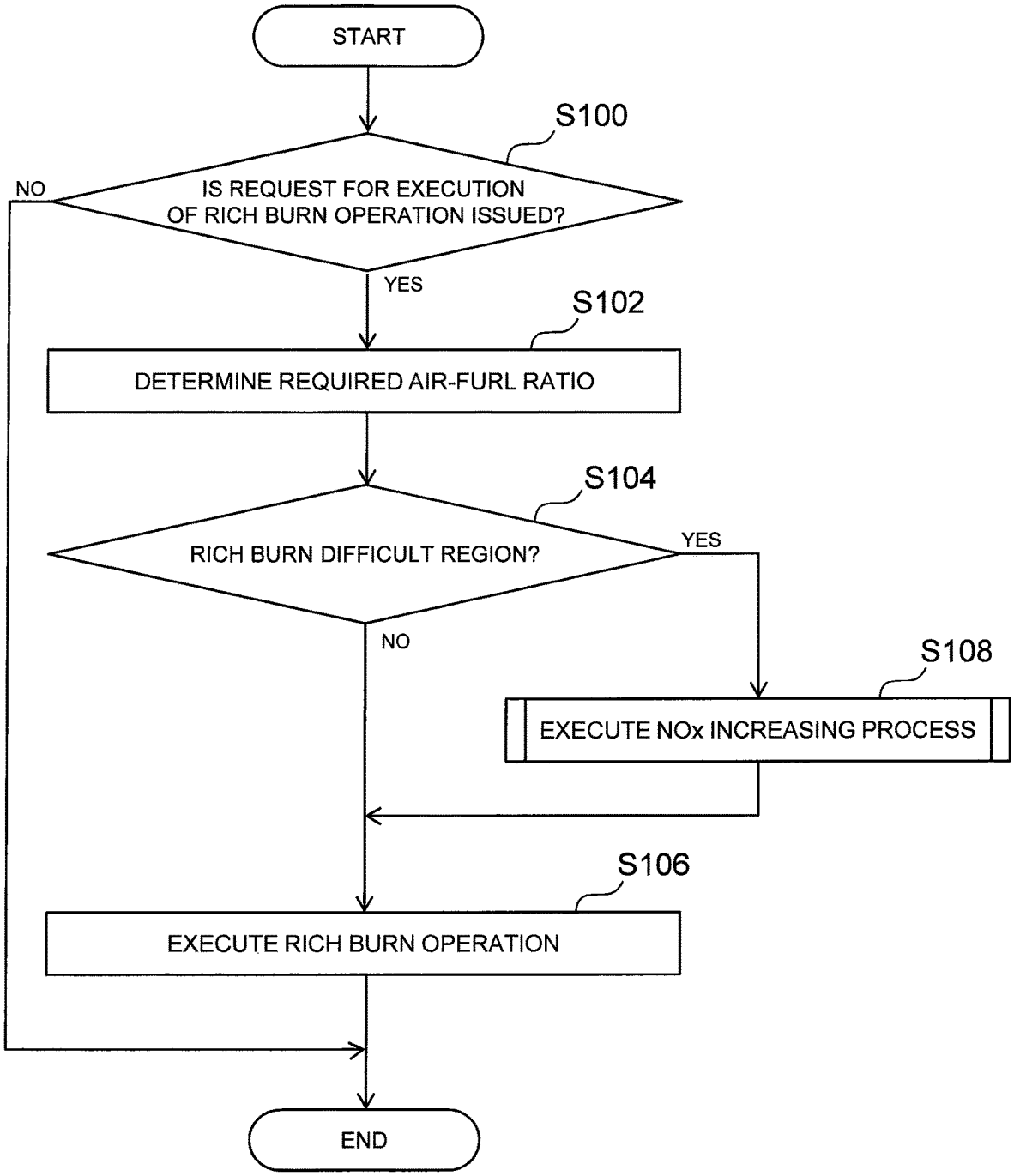
FIG. 8 is a flowchart of a routine executed by the system of the first embodiment during the lean burn operation.

FIG. 8 is a flowchart of the routine executed by the system of the first embodiment during the lean burn operation. In the routine illustrated in FIG. 8, first, the ECU 30 determines whether a request for the execution of the rich burn operation is issued (step S100). Here, the ECU 30 determines that the request for execution is established when the stored amount of NOx estimated based on detection values from various sensors exceeds a predetermined threshold value, for example. As a result, in a case where the determination is not satisfied, the ECU 30 determines that the lean burn operation may be continued, and this routine is ended.

On the other hand, in a case where the determination in step S100 is satisfied, the ECU 30 determines that the rich burn operation needs to be executed, and the process proceeds to the next step. In the next step, the ECU 30 determines the required air-fuel ratio in the rich burn control (step S102). Here, the ECU 30 determines the predetermined required rich air-fuel ratio (A/F=14.6, for example) according to the operating conditions of the engine 10 as the required air-fuel ratio.

In the next step, the ECU 30 determines whether the current operating conditions determined based on the engine load and the engine speed of the engine 10 belong to the rich burn difficult region illustrated in FIG. 2 (step S104). As a result, in a case where the determination is not satisfied, the ECU 30 determines that the rich burn operation can be executed while the ignition performance is secured. In this case, the process proceeds to the next step, and the ECU 30 executes the rich burn operation (step S106). Here, the ECU 30 controls the air-fuel ratio such that the in-cylinder air-fuel ratio becomes the required air-fuel ratio determined in step S102.

Figure 9:
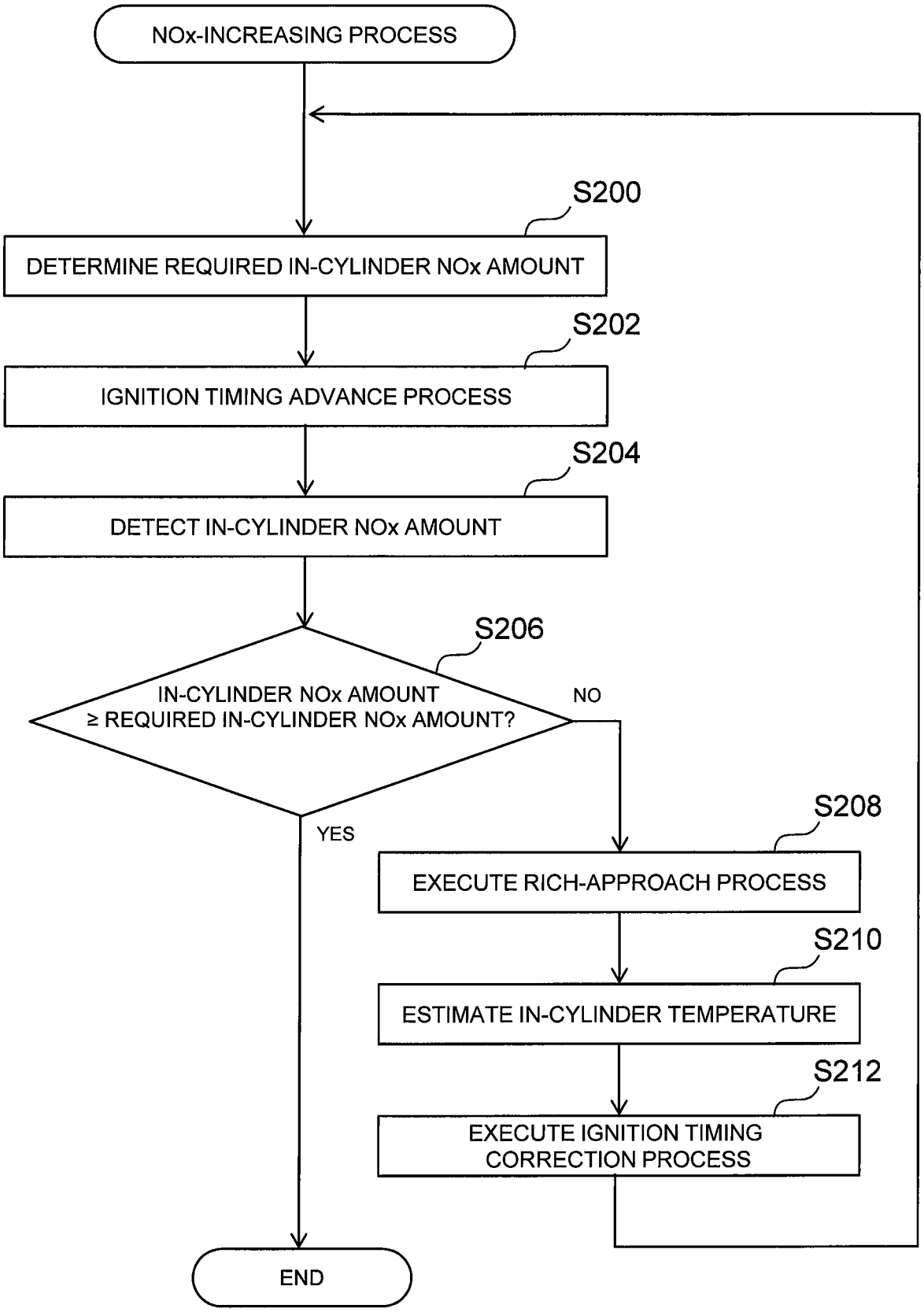
FIG. 9 is a flowchart illustrating a subroutine of the NOx-increasing process executed by the system of the first embodiment.

On the other hand, in a case where the determination is satisfied in the process of step S104, the ECU 30 executes the NOx-increasing process (step S108). FIG. 9 is a flowchart illustrating a subroutine of the NOx-increasing process executed by the system of the first embodiment. In step S108, the ECU 30 executes the subroutine illustrated in FIG. 9.

In the subroutine illustrated in FIG. 9, first, the ECU 30 determines the required in-cylinder NOx amount (step S200). Here, the ECU 30 determines the required in-cylinder NOx amount corresponding to the required air-fuel ratio determined in step S102 and the current intake air temperature detected by the temperature sensor 24, using the relationships shown in FIG. 5.

Next, the ECU 30 performs the ignition timing advance process so that the in-cylinder NOx amount approaches the determined required in-cylinder NOx amount (step S202). Specifically, the ECU 30 advances the ignition timing by advancing the fuel injection timing of a main injection or a pilot injection from the injector 8. When the ignition timing is advanced, the amount of NOx in the exhaust gas is increased, and thereby the in-cylinder NOx amount is increased.

Next, the ECU 30 detects the in-cylinder amount of NOx sucked into the cylinder based on the amount of NOx in the intake air and the intake air amount that are detected by the NOx sensor 22 (step S204). Next, the ECU 30 determines whether the in-cylinder NOx amount detected in step S204 is equal to or larger than the required in-cylinder NOx amount (step S206).

In a case where the in-cylinder NOx amount≥the required in-cylinder NOx amount is satisfied as a result of the process in step S206, the ECU 30 determines that since the in-cylinder NOx amount is increased, the rich burn operation can be executed while the ignition performance is secured. In this case, the subroutine illustrated in FIG. 9 is ended, and the process proceeds to step S106 in the routine illustrated in FIG. 8. In step S106, the ECU 30 executes the rich burn operation.

On the other hand, in a case where the in-cylinder NOx amount≥the required in-cylinder NOx amount is not satisfied as a result of the process in step S206, the ECU 30 determines that it is still difficult to execute the rich burn operation, and the process proceeds to the next process. In the next process, the ECU 30 executes the rich-approach process (step S208). Here, the ECU 30 calculates the rich-approach limit air-fuel ratio to shift the in-cylinder air-fuel ratio to the rich side based on the current intake air temperature and the in-cylinder NOx amount shown in FIG. 6. The ECU 30 controls the in-cylinder air-fuel ratio of the engine 10 to the calculated rich-approach air-fuel ratio.

When the above-described process in step S208 is performed, the ECU 30 estimates an in-cylinder temperature based on the current intake air temperature and the in-cylinder air-fuel ratio that are detected by the temperature sensor 24 (step S210). Next, the ECU 30 executes the ignition timing correction process (step S212). Here, the ECU 30 calculates an advanced angle amount of the ignition timing corresponding to the increase from the previous value of the in-cylinder temperature estimated in step S210. Then, the ECU 30 corrects the fuel injection timing of the main injection or the pilot injection from the injector 8 to be advanced, based on the calculated advanced angle amount.

When the above-described process in step S212 is performed, the process proceeds to step S200, again, and the required in-cylinder NOx amount is updated. When a series of processes of this subroutine are performed, the intake air temperature is increased. As shown in FIG. 5, when the intake air temperature is increased, the required in-cylinder NOx amount is reduced. Therefore, the required in-cylinder NOx amount updated in step S200 becomes smaller than the previous value.

Thus, when this subroutine processing is repeated, the in-cylinder NOx amount and the required in-cylinder NOx amount change to be closer to each other. When the in-cylinder NOx amount the required in-cylinder NOx amount is satisfied in the process in step S206, this subroutine processing is ended.

Figure 10:
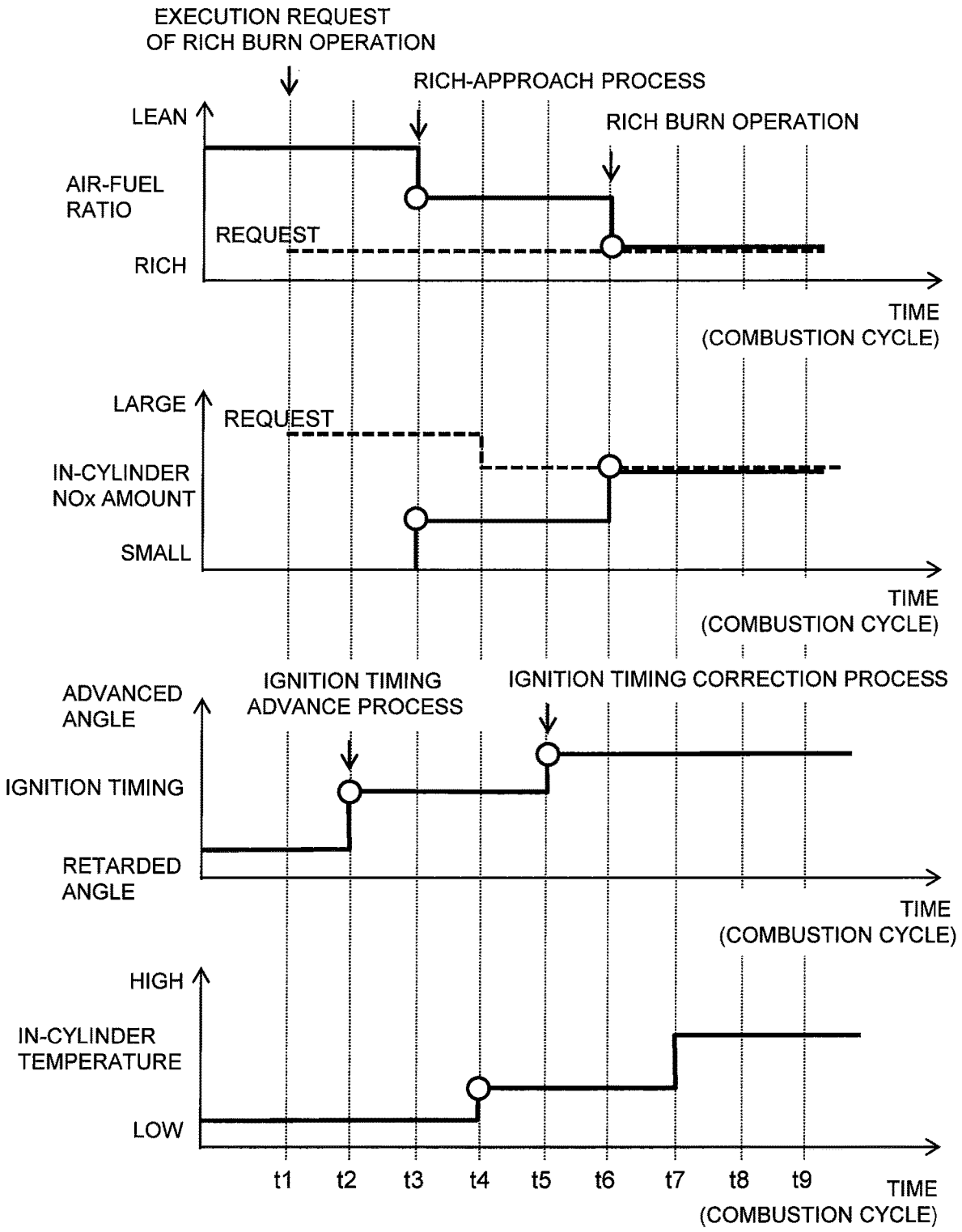
FIG. 10 is a time chart showing changes in various state amounts for each combustion cycle, in a case where the routines illustrated in FIGS. 8 and 9 are executed.

FIG. 10 is a time chart showing changes in various state amounts for each combustion cycle, in a case where the routines illustrated in FIGS. 8 and 9 are executed. Note that in FIG. 10, the first chart shows changes in the air-fuel ratio for each combustion cycle. The second chart shows changes in the in-cylinder NOx for each combustion cycle. The third chart shows changes in the ignition timing for each combustion cycle. The fourth chart shows changes in the in-cylinder temperature for each combustion cycle.

The charts shown in FIG. 10 each illustrate a case where a request for the execution of the rich burn operation is issued at time t1. Note that the operating conditions of the engine 10 belong to the rich burn difficult region when the request for execution is issued, and the in-cylinder NOx amount is smaller than the required in-cylinder NOx amount. In this case, the ignition timing advance process is performed at time t2 as the subsequent combustion cycle.

When the ignition timing advance process is performed, the in-cylinder NOx amount is increased. The rich-approach process is performed in response to the increased in-cylinder NOx amount at time t3 as the subsequent combustion cycle. When the rich-approach process is performed, the in-cylinder temperature is increased. The required in-cylinder NOx amount is reduced in response to the increased in-cylinder temperature at time t4 as the subsequent combustion cycle.

The ignition timing correction process is performed in response to the increased in-cylinder temperature at time t5 as the subsequent combustion cycle. When the ignition timing correction process is performed, the in-cylinder NOx amount is increased. The rich burn operation is executed when the in-cylinder NOx amount reaches the required in-cylinder NOx amount at time t6 as the subsequent combustion cycle.

Thus, according to the system 100 of the present embodiment, the operating region in which the rich burn operation can be executed can be expanded by increasing the in-cylinder NOx amount. Thereby, the delay of the execution timing of the rich burn operation can be prevented, thereby capable of preventing emission from deteriorating.

1-8. Modification Example of System in First Embodiment

Modified forms may be adopted to the system 100 of the first embodiment, as follows.

The determination in step S104 of the routine illustrated in FIG. 8 is not essential. Specifically, when the operating conditions of the engine 10 belong to the rich burn enabled region, the intake air temperature is higher than that when the operating conditions of the engine 10 belong to the rich burn difficult region, whereby the required in-cylinder NOx amount is reduced. Therefore, even when the process is proceeds to the NOx-increasing process in step S108 by skipping the determination in step S104, the lean burn operation can be switched to the rich burn operation by satisfying the determination in step S206.

The rich-approach process performed in the system 100 of the present embodiment is not essential. Specifically, in the subroutine illustrated in FIG. 9, when the determination is not satisfied in step S206, the process may proceed to the process in step S210 by skipping the rich-approach process in step S208.

The ignition timing correction process performed in the system 100 of the present embodiment is not essential. Specifically, in the subroutine illustrated in FIG. 9, the process may be returned to the process in step S200 after the process in step S210, by skipping the ignition timing correction process in step S212.

What is claimed is:

1. An exhaust gas purification system for an internal combustion engine, comprising:

a catalyst provided in an exhaust passage of the internal combustion engine and having an NOx storage and reduction function;

an EGR passage for returning exhaust gas provided upstream of the catalyst into a cylinder of the internal combustion engine; and a controller configured to control combustion of the internal combustion engine, wherein operation modes of the internal combustion engine selected by the controller include:

a lean burn operation in which an in-cylinder air-fuel ratio of the internal combustion engine is controlled to a lean air-fuel ratio leaner in fuel than a theoretical air-fuel ratio to operate the internal combustion engine; and a rich burn operation in which the in-cylinder air-fuel ratio is controlled to a required rich air-fuel ratio richer in fuel than the theoretical air-fuel ratio to supply a reducer to the catalyst, and the controller is configured to switch the operation mode from the lean burn operation to the rich burn operation when a request for execution of the rich burn operation is issued during the lean burn operation, and the controller is configured to perform, when the request for execution is issued, an NOx-increasing process in which the combustion of the internal combustion engine is controlled so that an in-cylinder NOx amount which is an amount of NOx sucked into the cylinder through an EGR passage is equal to or larger than a required in-cylinder NOx amount which is a required value of the in-cylinder NOx amount prior to switching to the rich burn operation.

2. The exhaust gas purification system according to claim 1, wherein the NOx-increasing process includes setting the required in-cylinder NOx amount based on an intake air temperature of intake air sucked into the cylinder and the required rich air-fuel ratio.

3. The exhaust gas purification system according to claim 1, wherein the NOx-increasing process includes an ignition timing advance process in which ignition timing of the internal combustion engine is advanced.

4. The exhaust gas purification system according to claim 3, wherein the ignition timing advance process includes advancing fuel injection timing of the internal combustion engine.

5. The exhaust gas purification system according to claim 3, wherein the NOx-increasing process includes a rich-approach process in which the in-cylinder air-fuel ratio is controlled to a rich-approach air-fuel ratio leaner in fuel than the required rich air-fuel ratio based on the in-cylinder NOx amount and the intake air temperature of the intake air sucked into the cylinder.

6. The exhaust gas purification system according to claim 5, wherein the NOx-increasing process includes an ignition timing correction process in which the ignition timing is further corrected to be advanced based on changes in in-cylinder temperature after the rich-approach process.

7. The exhaust gas purification system according to claim 5, wherein the NOx-increasing process includes updating the required in-cylinder NOx amount based on the intake air temperature after the rich-approach process.

* * * * *